US005641071A

United States Patent [19]

Read et al.

[11] Patent Number: 5,641,071

[45] Date of Patent: Jun. 24, 1997

[54] CONVERTIBLE MATERIAL SEPARATING APPARATUS, AND CONVERTIBLE KITS

[75] Inventors: James L. Read, Hingham; Robert J. Hadden, Middleboro, both of Mass.

[73] Assignee: The Read Corporation, Middleboro, Mass.

[21] Appl. No.: 497,370

[22] Filed: Jun. 30, 1995

[51] Int. Cl.[6] ..... B07B 1/49

[52] U.S. Cl. ..... 209/319; 209/409; 209/413; 209/420

[58] Field of Search ..... 209/313, 314, 209/319, 393, 395, 397, 399, 401, 403, 405, 408, 409, 412, 413, 420, 421

[56] References Cited

U.S. PATENT DOCUMENTS

| | | | |
|---|---|---|---|
| D. 263,836 | 4/1982 | Read . | |
| 4,197,194 | 4/1980 | Read | 209/409 X |
| 4,237,000 | 12/1980 | Read et al. | 209/420 |
| 4,256,572 | 3/1981 | Read | 209/420 X |
| 5,219,078 | 6/1993 | Hadden | 209/393 X |
| 5,322,170 | 6/1994 | Hadden | 209/319 X |

FOREIGN PATENT DOCUMENTS

| | | | |
|---|---|---|---|
| 409659 | 1/1991 | European Pat. Off. | 209/420 |

*Primary Examiner*—William E. Terrell
*Assistant Examiner*—Tuan Nguyen
*Attorney, Agent, or Firm*—Richard P. Crowley

[57] ABSTRACT

A convertible vibratory material separating apparatus, and kits to convert the apparatus to a woven-screen or finger-rod upper separating surface. The separating apparatus includes a universal shaker head adapted for vibratory movement within a frame with a tall and short end. The shaker head includes side plates and a centerplate, and removable support rails or plates when the shaker head is converted to finger-rod combs for a separating surface. The shaker head includes flanges on a lateral support tube enclosing an eccentric motor driven shaft and flanges when the shaker head is converted to a woven-screen upper separating surface. The kits include right angle flanges, bars and plates for conversion of the shaker head with woven-screens or combs of finger-rods.

15 Claims, 6 Drawing Sheets

CONVERTIBLE MATERIAL SEPARATING APPARATUS, AND CONVERTIBLE KITS

BACKGROUND OF THE INVENTION

Existing road-portable, or towable, commercial material screening equipment generally is either of one or two distinct designs or configurations. Each design and configuration includes a frame and one or more, typically a pair, of sloping, vibratory shaker surfaces supported within the frame. The frame has a tall end and a short end, joined by two sides, and has funneling surfaces on the sides inwardly directed to funnel feed material to a shaker head with a screen surface to separate soil or other waste material. The material to be screened is dumped onto the upper surface, such as by a payloader, and the larger material falls from the short end of the primary screening surface; while material which is smaller than the primary surface passes through the surface to a lower separating surface, with dimensions to permit coarser material to be discharged from the one short end of the frame, and finer material to fall to an open space within the frame or onto a conveyor belt for retrieval from the open space.

The first and most common soil separating apparatus has a primary surface composed of woven wire, for example, a woven wire or perforated flat surface. Such vibratory separating material apparatus, are described, for example, in U.S. Pat. Nos. 4,197,194, 4,237,000 and 4,256,572, and U.S. Pat. No. 065,263,836, all hereby incorporated by reference. These apparatus are known in the industry as Screen-All® soil separators (Screen-All is a registered trademark of James L. Read of Middleboro, Mass.).

A second material separating design is not as widely employed, but is desirable in many special applications, such as in separation of soil compacted with or without waste, or with a wide variety of combinations of different types of materials. The second apparatus is useful due to its high level of effectiveness with other materials problems. The second separating material apparatus is designed with a plurality of vibrating fingers or elongated rods as the primary upper separating surface. Cylindrical rods or fingers are mounted as combs in planar rows, which overlap to form separate tiers or decks and are fit into shaker mechanisms or apparatus in a downwardly inclined arrangement. The plurality of combs are designed to form a pattern of staggered layers that breaks up the unscreened material that rolls upon it, and breaks up the material as it passes from the tall to the short end of the frame. This second type of waste material separating apparatus is described, for example, in U.S. Pat. No. 5,219,078 issued Jun. 15, 1993 and U.S. Pat. No. 5,322,170, issued Jun. 21, 1994, both hereby incorporated by reference.

The existing screening equipment, with either the first or second designed shaker heads or even combination shaker heads, do not have capacity to be interchangeable. A significant need does exist in the industry, however, for interchangeable shaker heads; that is, interchangeable upper separating surfaces. There have been efforts to provide add-on screening apparatus, which attempt to offer the benefits of either woven wire or rod-finger upper screening surfaces. These existing add-on separating apparatus, in order to function, actually lessen the overall performance and longevity of the originally designed vibratory separating apparatus. For example, such add-ons increase the overall height of the existing apparatus, and therefore create problems for the discharge of material by a backhoe or payloader onto the add-on upper separating surface. Further, in order to obtain a single soil separating apparatus machine for convertibility of the upper material screening separation, the overall effectiveness of the apparatus is compromised.

Thus, it is desired to provide an improved waste material vibratory separating apparatus with a universal shaker head with means to provide for interchangeable screening surfaces on its primary upper surface, that is easy to change and does not compromise the height or effectiveness of the screen apparatus in use.

SUMMARY OF THE INVENTION

The invention relates to a material screening apparatus having an interchangeable shaker head and which apparatus is convertible to accept different separating surfaces on the shaker head, and to kit assemblies for the conversion of the material separating apparatus to either a woven-screen or plate, or rod-finger formation as the primary separating surface, and to a method of affecting such apparatus conversion.

The invention comprises material separating apparatus with the shaker head structurally arranged and designed, so that the shaker head can be interchangeably outfitted by the user, with either an upper woven-screen/plate separating surface; that is, a woven wire or perforated plate of selected dimensions or openings, or a rod-finger comb-like separating surface. The invention provides for the interchangeability of the separating surfaces without the problems and disadvantages which are associated with the mounting of separate apparatus, onto the upper portion or above the existing vibratory separating surfaces. A prior vibratory material separating apparatus has provided for the replacement of the lower woven-screen/plate, in a two-tiered woven-screen/plate apparatus; however, the top or upper primary separating surface is not replaceable. The invention provides for the component parts of the shaker head within the material separating apparatus frame to interconnect and co-function with the selected upper separating surface with the kit thereof, without disturbing the productivity of the screen apparatus method or without increasing the overall height of the apparatus.

The invention concerns an improved material separating apparatus with a redesigned universal shaker head which permits easy and effective conversion by the user of the upper separating surface for a different type, that is between a screen/plate or a rod-finger separating surface, while the lower separating surfaces may be either a screen/plate or rod-finger as desired. The invention includes a conversion kit containing the structural ingredients for the conversion of the separating apparatus. The invention also includes a method of converting the material separating apparatus with the redesigned shaker head between the respective selected separating surfaces.

Existing shaker head designs for the screen/plate separating apparatuses are designed for vibratory movement within the frame, and designed to support a selected upper and lower screen/plate separating surface. The shaker head comprises a top lateral bar, or back plate, and a bottom, generally parallel lateral bar, or S-piece, and connecting upright side plates, a permanently welded support centerplate, and at least two side vertical support plates extending in a spaced-apart, generally parallel arrangement from the top back plate to the bottom bar, or S-piece, to provide proper screening support. The shaker head bottom bar, or S-piece, is generally rounded and extended downwardly to permit the discharge of the coarse particulate material outside the frame at the short end. The lower edge of the bottom bar/S-piece is spaced apart from the lower support bars and woven screens to provide an opening to discharge material outside the frame at the short end, which material passes through the upper screen/plate, but does not pass through the lower screen/plate, while the finer material is permitted to be discharged or fall within the frame.

The shaker head includes outward flanges on each side plate for connecting to the lower part of the frame, and is secured to spring means to permit the forward vibratory movement of the shaker head within the frame in response to the eccentric movement of the hydraulic motor-drive rotating shaft, the shaft usually extended generally laterally through the shaker head and through the side plates thereof. The rotating drive shaft is placed within a central support tube, and extended outwardly from each end of the side plates, with a guide assembly at one end, coupling to a hydraulic driving motor. Usually, the shaker head includes separate support tubes generally equidistantly spaced apart from and parallel to the central support tube, with the shaft extending between the side plates. The lower screen plate is supported on spaced-apart, parallel bars running from the lower lateral bar beneath the lower edge of the bottom and top bars. The lower screen/plate is removably secured to these lower support bars.

While the shaker head of the prior art material separating vibratory apparatus is satisfactory, where the selected woven-screen/plate is to be selected and used, the selected woven-screen/plate can not be replaced with rod-fingers, and therefore modifications in the shaker head structure and design are required to permit a user to select a screen/plate or rod-finger conversion kit, and to use the components of the kit to provide for the effective operation of either upper separating surface.

The material separating apparatus of the invention, with the redesigned shaker head, requires that some of the side lateral centerplates be removably secured to the head rather than permanently welded, such as by bolted brackets at each end, and that the welded centerplate and the welded lateral side plates contain a plurality of holes for the securing of the various structural components of either kit to the plates. In addition, the universal shaker head design includes mounting clips secured to the top back plate and bottom bar/S-piece, as well as outwardly extended clip means generally secured to the central support tube and other support tubes, to permit the installation of kit components, like additional lateral support plates, from the woven-screen/plate conversion kit. Thus, the shaker head requires mounting clips as well as longitudinal flanges secured to the central shaft support tube, so that additional elongated plates can be secured thereto, but which longitudinal flanges on the support tube and removable end mounting clips do not interfere with and can be removed from the shaker head on conversion of the material separating apparatus for use of the upper finger-rod separating surface. While reference is made to an upper separating surface, it is recognized that the upper separating surface may be the sole screen/plate or rod-finger surface, or there may more typically be a lower or even more lower separating surface.

The invention comprises a material separating apparatus, particularly a road-portable, particulate soil and waste material separating apparatus, having at least one upper and preferably two or more spaced apart separating surfaces on a vibratory shaker head, the shaker head supported within a frame of the apparatus. The frame has a tall and a short end, and connecting sides, and generally inwardly directed, funneling surfaces on three sides thereof, and defines an interior open space, into which space finer material falls from the lower separating surface. Where the apparatus is portable, the frame generally includes wheels at the one end, on either side moveable between a road transport and a non road transport position, and a towing bar at the other end for the towing of the apparatus over the roads to a work site.

The apparatus includes a motor, generally a hydraulic drive motor, to drive an eccentric-rotating shaft to provide forward-type vibratory movement to the spring-mounted shaker head and to the separating surfaces secured to the shaker head. The shaker head has outwardly extending flanges from its side plates and is spring mounted within the frame for vibratory movement, and includes top back plate and bottom S-pieces and connecting upright side plates, and a central lateral support tube which encloses the rotating shaft, and generally two or more spaced apart, parallel flanking support tubes upon either side thereon. The shaker head includes a longitudinal welded support centerplate, extending from the top back plate and bottom bar/S-piece, and generally at least two welded side supporting plates spaced apart and generally parallel to the central plate. The shaker head side plates, the vertical side supporting plates, and the support centerplate all have a plurality of holes therein for bolting; i.e., securing clips and flanges and other structural components of the selected screening kit thereto.

The shaker head also includes means to secure elongated plates of the kit components to the central shaft support tube, and generally comprises longitudinal, outwardly extending flanges or mounting clips on either side of the central, and optionally other, support tubes, and intermediate the longitudinal centerplate and the other side plates, with the clips generally aligned with bolted mounting clips at the one and other end of the top back plate and bottom bar/S-piece, which flanges and mounting clips are employed when the upper surfaces comprise a woven-screen or perforated plate surface.

The invention includes a screen head conversion kit to use with the separating apparatus to provide a woven-screen/perforated plate on the upper separating surface on the shaker head. The kit comprises a woven metal screen/plate, either as a single screen/plate or more usually, depending on the size of the apparatus, a plurality of separate screens/plates, and each extending from the top to the bottom of the frame of the apparatus; that is, from the tall to the short end, with each frame screen/plate supported within the shaker head for vibratory movement. Support plates, typically right angle side support plates, contain a plurality of holes along the length and are adapted to be bolted along the side plates of the frame, with a flange extending inwardly on each side and an additional pair of right angle support plates which are adapted to be bolted on either side of the support centerplate of the shaker head apparatus, and extend laterally outward, and together with a plurality, usually in even pairs, for example, four or six, longitudinal extra right angle support plates with holes therein. The support plates, or rails, have a bottom edge, curved and adapted to fit snugly against the support tubes and extending through the shaker head, and with the upper edge being a straight edge similar to the central support plate and the lateral support plates. The woven-screens are adapted to be secured to the flange securing or clip means on the tube support between the welded support centerplate and on either side of the welded vertical side support plates. The side plates, and support plates, all have selected positioned holes to permit kit components to be secured thereto.

Once all the components are secured, i.e. bolted, in place, the lateral plate supports provide a platform on which to place, for example, three or four or more separate woven screen/plates within the shaker head, and the woven-screen/plates are bolted into place from top to bottom, against the extending lateral surfaces of the right angle flanges employed. The screen head conversion kit, thus consisting of one or more woven-screens/perforated plates in a frame together with a plurality of longitudinal support plates with holes to be secured onto the securing means on the support frames, and together with a plurality of right angle flanges to be secured to the lateral sides and the existing frame. Therefore, a screen head conversion kit is provided to convert the universal shaker head to support a woven-screen/plate as the upper primary separating surface.

The finger-rod head conversion kit comprises a single or more aptly, a plurality of finger mounting rods with a plurality of spaced apart, generally parallel, laterally extended fingers bolted at one end to the finger mounting rod to form separate combs. Usually the finger mounting rod extends laterally, and the amount extending longitudinally depending upon the size of the upper separating surface and the number of tiers involved. For example, the number of mounting rods and fingers which, for example, typically are eight to twenty finger-rods per finger mounting bar or comb, and may comprise three to four laterally and three to four longitudinally, where there are three to four overlapping tiers or decks. The rod-finger head conversion kit would also include a plurality of right-angled brackets, more particularly two or more, typically three or four or more elongated longitudinal finger rod support rails or plates, having a plurality of holes around the lower edges and having a curved lower edge which fits snugly about the generally lateral and center support tubes of the shaker head, and having a curved intermediate and lower edges to accommodate the movement of the fingers or rods in use, which support rails or plates are bolted to the welded vertical support plates. The right angle brackets are adapted to be secured to the elongated finger-rod supporting plates, with the rail or support plates used in place of the support centerplate, and the two lateral vertical side support plates.

In use, a portable, road-transportable material separating apparatus with the universal designed shaker head, is sold together with an option for would-be purchasers to purchase either a finger-rod conversion kit or a screen/plate conversion kit or both, wherein a universal shaker head may be converted by a user in the field on its upper screening surface to either finger-rod upper screening surface or a woven/plate screening surface without the disadvantages of additional height and with the advantages of rapid reconvertibility and effectiveness.

The material separating apparatus of the invention, with the improved shaker head and the woven-screen head conversion kit and the rod-finger head conversion kit and the method of assembling and operating the apparatus, will be described for the purpose of illustration only in connection with certain illustrated embodiments; however, it is recognized that various changes, modifications, additions and improvements may be made by those person skilled in the art without departing from the spirit and scope of the invention.

DESCRIPTION OF THE EMBODIMENTS

Figure 1:
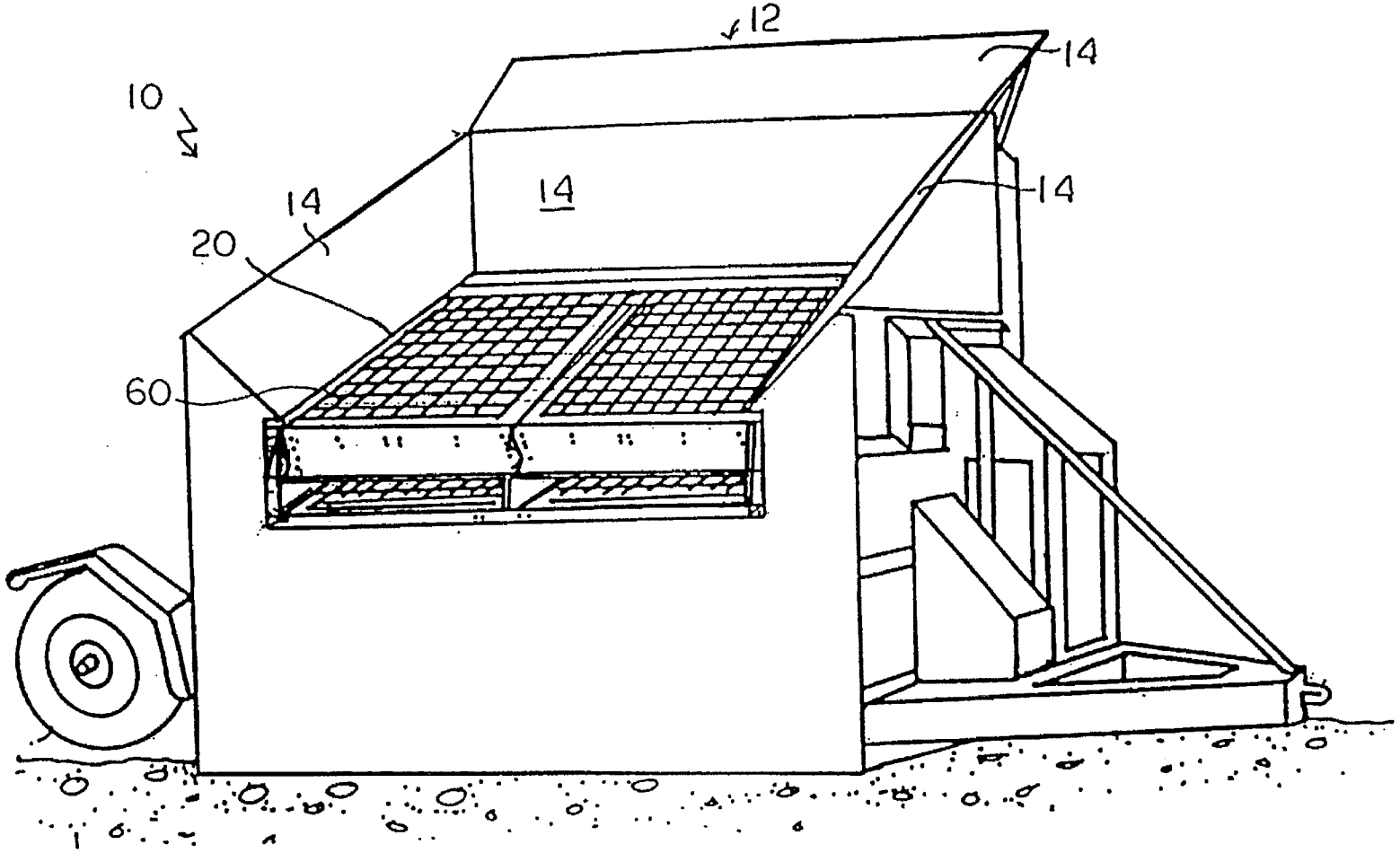
FIG. 1 is a perspective view of the improved material separating apparatus of the invention showing and displaying the universal shaker head without the use of an upper screening surface and showing a lower woven screening surface.

As shown in the drawings, FIG. 1 is a perspective view of the improved material separating apparatus of the invention 10. The convertible universal vibratory shaker head 20 within the road-transportable frame 12 is shown positioned on the top surface of the apparatus, with the screen kit 60 secured thereto.

The apparatus 10 has an outer frame 12 with side supports 14 to allow the deposit of waste material onto the shaker head 20 to be screened. A second screening deck 16 is positioned directly below the universal shaker head 20, spaced apart and parallel to the shaker head screen surface and generally downwardly sloping and integral within the shaker head apparatus. The lower deck 16 may be either a woven-screen or rod-finger combination, but is shown here with a woven-screen 17.

Figure 2:
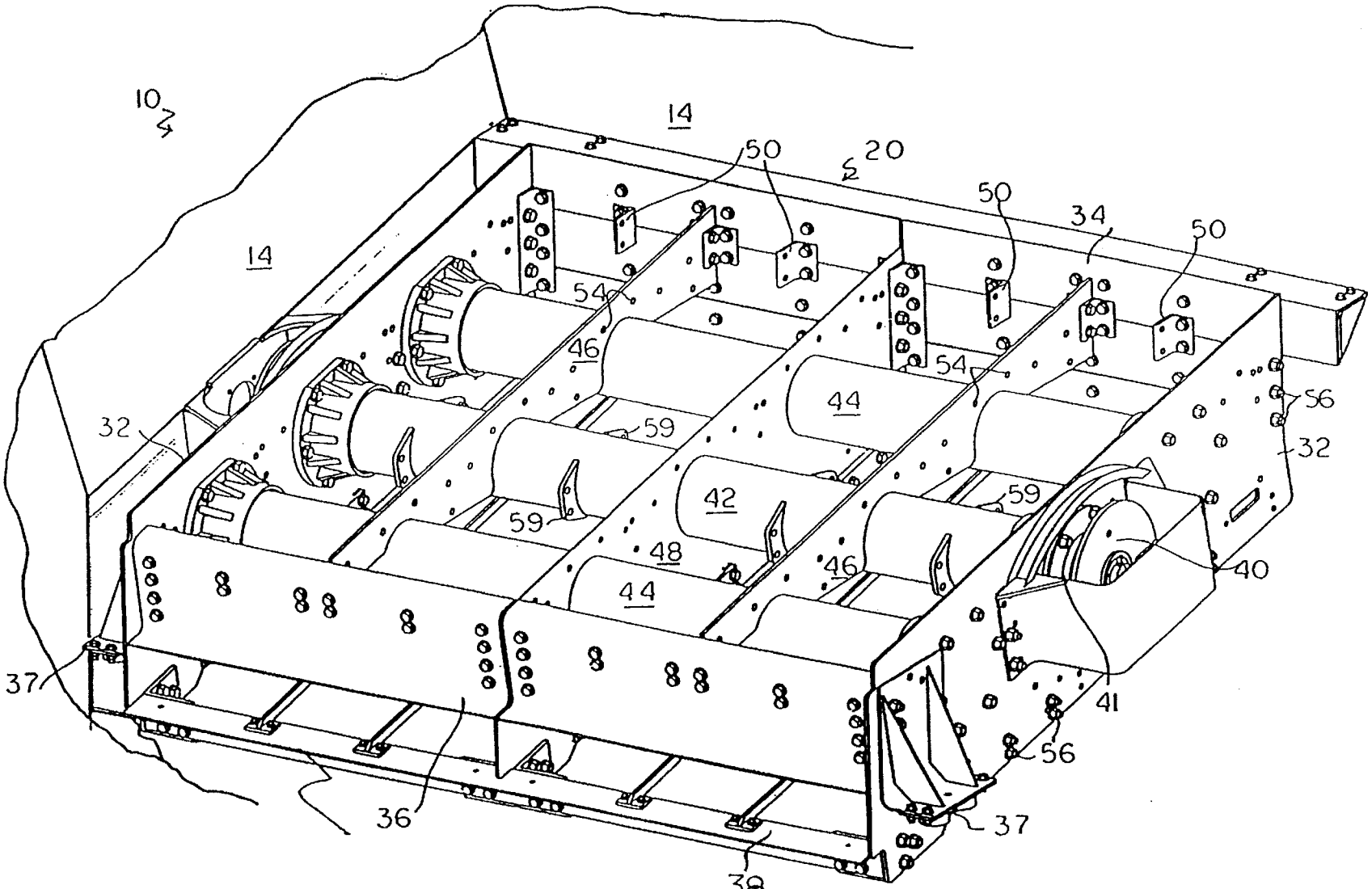
FIG. 2 is an enlarged, fragmentary view of a section of the apparatus of FIG. 1 showing the universal shaker head in greater detail.

FIG. 2 shows an enlarged, fragmentary view of the apparatus of the invention 10, with the universal shaker head 20 shown in greater detail. The shaker head 20 has two upright side plates 32, back plate 34 and bottom S-piece 36 secured together with outwardly extended flanges 37 to permit the universal shaker head 20 to be secured to the waste material separating apparatus frame 10. The upright side plates 32 are further connected to the lower deck frame 38, which frame allows for the placement of either a woven-screen or rod-finger apparatus to be affixed thereto. Within the frame, the vibratory shaker shaft 41 is housed within the center support tube 42 and is positioned intermediate between the bottom S-piece 36 and back plate 34 frame supports and secured to the upright side plates 32 with bolts 56. The center support tube 42 is connected to a shaft drive motor 40 to provide vibratory movement to the shaker tube 42 and 40 the separating surface decks thereon. Two flanking support tubes 44 are positioned on either side of the shaker tube 42 and are secured at either end to the upright side plates 32 with bolts 56. Vertical support plates 46 and vertical support centerplate 48 are secured to the shaker tube 42 and flanking support tubes 44. The vertical support plates 46 and vertical support centerplate 48 have curved edges on their bottom surfaces to snugly fit around the central support tube 42 and flanking support tubes 44. The support plates further have holes 54 spaced at specific locations for the placement of bolts 56 to secure the rod-finger or woven-screen mounting plates as desired by the user.

The shaker head 20 has outwardly extending right angle flanges 50 attached to the bottom S-piece 36 and back plate 34, which flanges 50 are bolted to the frames, for securing the woven-screen support rails 62 thereto. Bolt holes 54 are also positioned on the bottom S-piece 36 and back plate 34 supports for securing the finger rod mounting brackets 94,96 thereto. The central support tube 42 has eight mounting clips 59 positioned on either side of the tube 42 and intermediate between each divided section provided by the vertical support plates 46 and vertical support centerplate 48. These mounting clips 59 have holes therein for securing woven-screen mounting rails 62. While this embodiment shows eight mounting clips, it is recognized that any number of mounting clips may be used, the quantity being determined by mode.

Figure 3:
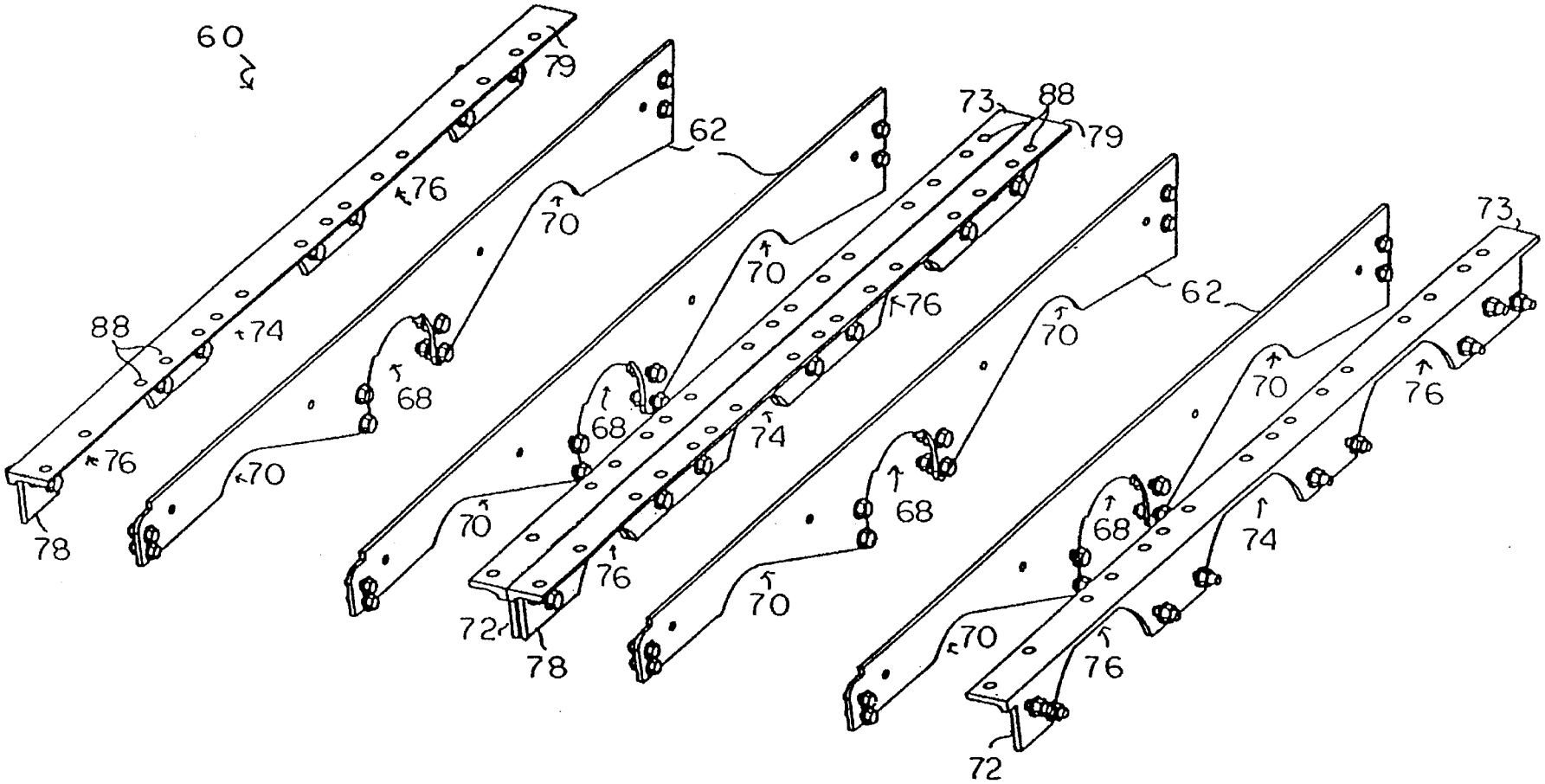
FIG. 3 is a perspective, exploded view of a screen shaker head conversion kit shown with a single screen in partial cutaway.

FIG. 3 shows an exploded view of the woven-screen shaker head conversion kit 60 with woven-screen support rails 62 having a flat upper surface with a generally downwardly extending slope to permit the downward movement of the waste material when it is deposited on the woven-screen. The woven-screen support rails 62 further have curved bottom edges 70 to snugly fit over the support tubes 44 and a central curved bottom edge 68 to snugly fit over the central support tube 42. Bolts 86 are positioned on either side of the central curved edge 68 and at both ends of the support rails 62 to provide for securing the support rails to the mounting clips 59 positioned on the central support tube 42 and the right angle flanges 50. Right angle screen mounting support brackets 72 and 78 are secured to one and the other of the upright side plates 32 and on either side of the vertical support centerplate 48. These right angle screen mounting support brackets have holes 88 on their side 78, 72 and top surfaces 73, 79 to provide for securing of the woven-screen frame 134 to provide a woven-screen separating surface 132. The right angle screen mounting support brackets 72 and 78 also have curved bottom edges 74 and 76, to fit snugly over the central support tube 42 and flanking support tubes 44 respectively.

Figure 4:
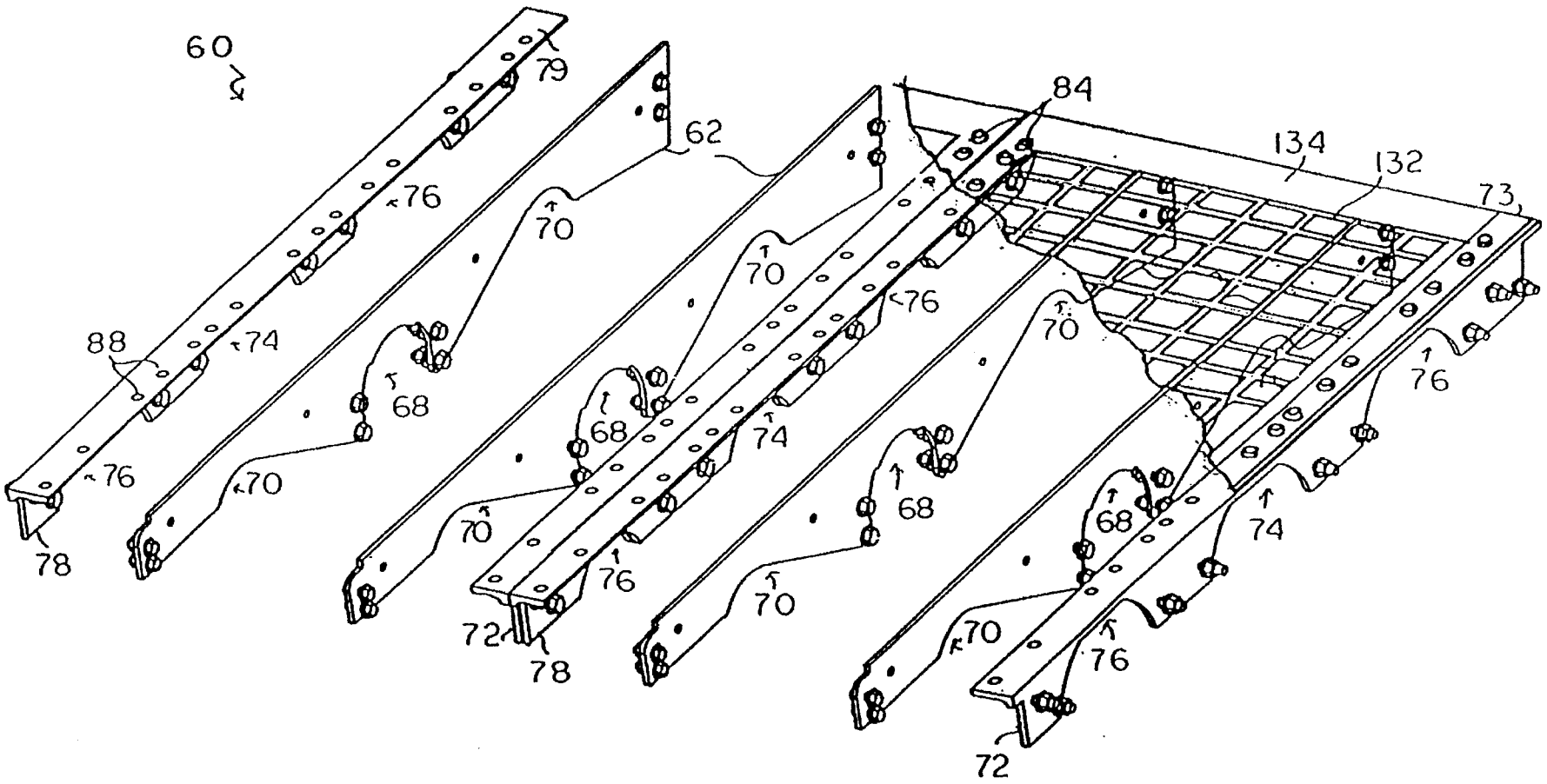
FIG. 4 is a perspective, cutaway view of the screen head conversion kit assembled on the universal shaker head.

FIG. 4 shows a partial view of the assembled woven-screen conversion kit 60 in place on the universal shaker head 20. The frame 134 of the woven-screen 132 is secured to the side and central right angle screen mounting supports 72, 78 by securing bolts 84 to the holes 88 provided. Woven-screen support rails 62 provide support for the woven-screen 132 when heavy waste material is deposited thereon for separating. The woven-screen support rails 62 and right angle screen mounting support brackets 72, 78 are secured to the central support tube 42 and flanking support tubes 44 with mounting clips 59 and mounting clip bolts 86 in the holes provided.

Figure 5:
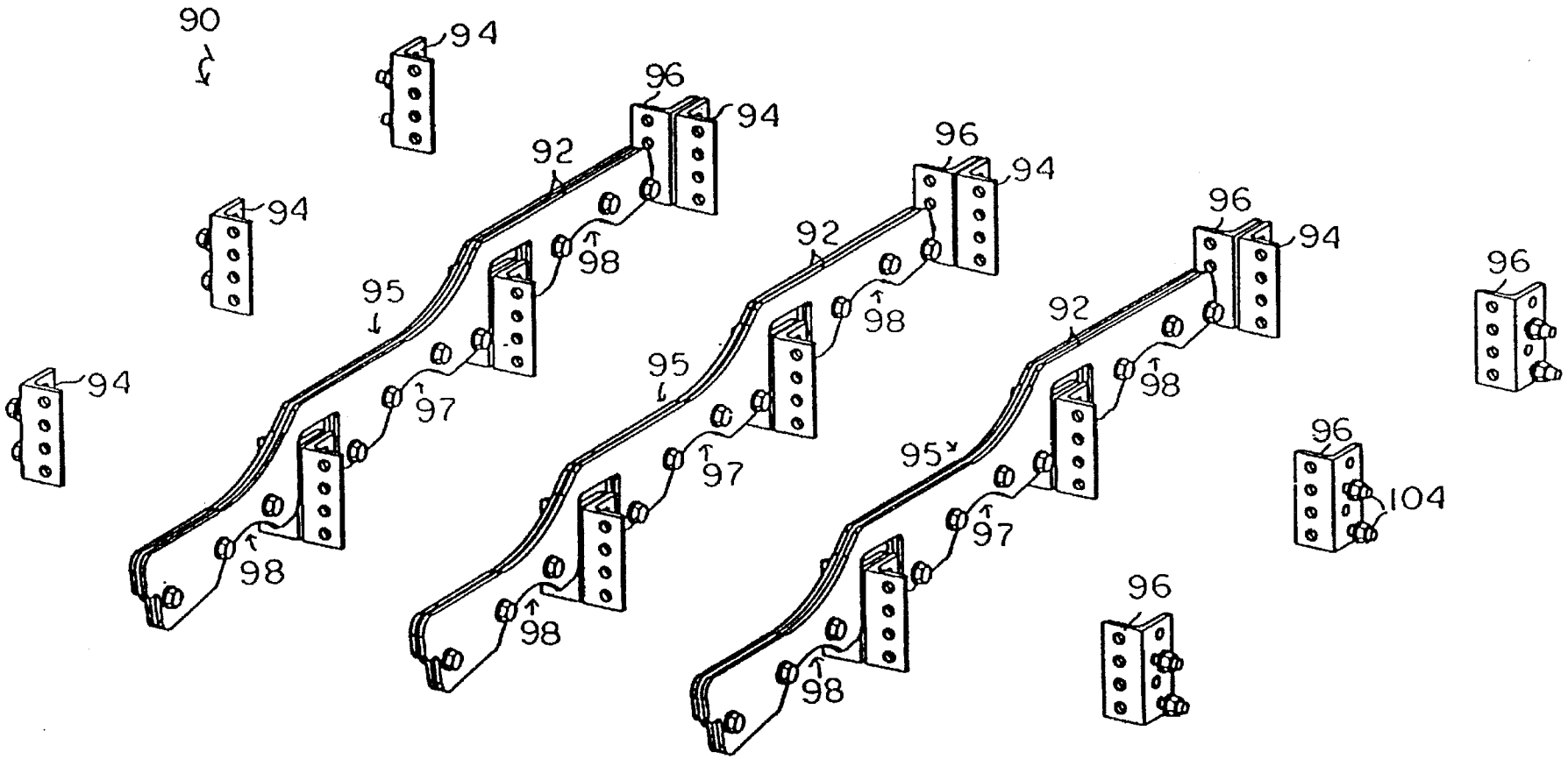
FIG. 5 is a perspective, exploded view of the rod/finger head conversion kit shown with a rod/finger attachment in partial cutaway.

FIG. 5 shows an exploded view of the rod-finger shaker head conversion kit 90 with six lateral support plates 92 having downwardly sloping and curved top edges 95 and curved bottom edges 97 and 98 to snugly fit over the center support tube 42 and flanking support tubes 44 respectively. The lateral support plates 92 are positioned on either side of the shaker head side vertical supports 46 and vertical support centerplate 48 and bolted in place with bolts 100. Three sets of finger rod mounting brackets 94 and 96 are positioned on either side of the lateral support plates 92, against the back plate 34, and two placed intermediate therebetween, to provide for the securing of the finger mounting rods 114. The finger mounting rods 114 are secured to the finger rod mounting brackets 94 and 96, with the combs 112 connected to the finger mounting rods 114 and extending downwardly and outwardly therefrom. The combs provide a continuous, vibratory surface extending from the back plate 34 to the bottom S-piece 36, the combs 112 being open at their outward end to permit vibration of the combs when the shaker head is activated. The finger rod mounting brackets 94, 96 are secured to the frame by means of bolts 104.

Figure 6:
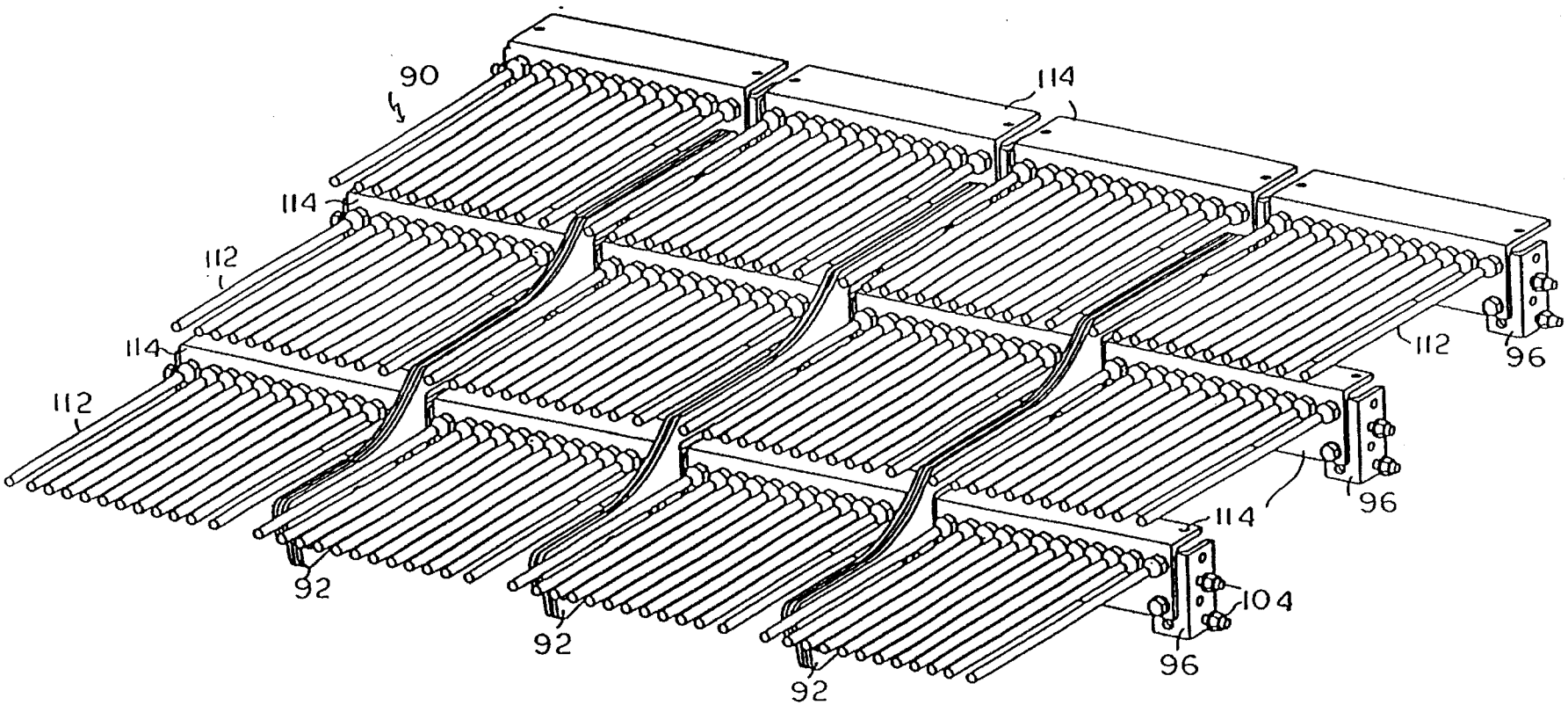
FIG. 6 is a perspective, cutaway view of the rod-finger head conversion kit assembled on the universal shaker head.

FIG. 6 is a perspective, view of the assembled finger-rod conversion kit 90 in place on the convertible universal shaker head of the invention 20. The combs 112 extend from the finger mounting rods 114 in a downwardly sloping, outward manner. The finger mounting rods 114 are bolted to the lateral support plates 92 with finger rod mounting brackets 94 and 96. The finger-rod lateral support plates 92 are bolted to the shaker head vertical support plates 46 and 48 to provide support for the rod-fingers in use. The central shaker head shaft 42 provides vibratory movement of the finger-rods.

In use, the waste material apparatus of the invention 10, with the universal shaker head 20 is purchased with either the woven-screen conversion kit 60, the finger-rod conversion kit 90, or both as desired. The road-transportable waste material separating apparatus is brought to a site where the waste material is to be separated, and a determination is made to use either the woven-screen kit 60 or the rod-finger kit 90. If the woven-screen kit is chosen, the user bolts the right angle screen mounting support brackets 72 and 78 to the upright side plates 32 and to either side of the vertical support centerplate 48. The woven-screen support rails 62 are then bolted to the mounting clips 59 located on the central support tube 42 and to the right angle flanges 50 on the back plate 34 and bottom S-piece 36 supports of the shaker head 20. The woven-screen frame 134 is then secured to the flat upper support surfaces 73 and 79 of the right angle screen mounting support brackets 72, 78, and the woven-screen is ready to use.

If the rod-finger conversion kit is chosen, the user positions the side lateral support plates 92 on either side of the vertical support plates 46 and vertical support centerplate 48 and secures them with bolts 100. The finger mounting rods 114 are then bolted to the right angle finger rod mounting brackets 94, 96 located on the vertical support plates 92. The combs 112, already attached to the finger mounting rods 114, are now in place and ready to receive waste material. The shaker shaft 41 within the center support tube 42 provides vibratory movement for the surfaces within the apparatus frame.

Thus, the waste material separating apparatus of the invention, with the universal shaker head, is easily convertible by simple nut and bolt means to either a woven screen surface or a finger-rod surface. The convertible shaker head, thus designed, does not add height to the waste material screening apparatus in use with a payloader depositing material onto the surface. The shaker head provides a vibratory movement for the convertible surface, thus providing all of the advantages of prior art waste material separating apparatus. The relatively easy conversion of the top surface is a noticeable advance in the art that saves the user the expense of buying two separate apparatuses to accomplish the variety of waste material separating applications presented in the industry.

What is claimed is:

1. A material separating apparatus having a convertible upper separating surface, said apparatus adapted for the separation of a feed material into a coarse material and a finer material, which apparatus comprises:

a) a frame having a tall and short end and adjoining sides, and defining an interior space for the receipt of the finer material, and having inwardly directed funneling surfaces at the tall end and adjoining sides, to direct feed material onto said upper separating surface;

b) a shaker head mounted for vibratory movement within said frame and having a top back plate, a bottom piece, and connecting side plates;

c) a motor including a shaft, to impart a vibratory movement to the shaker head;

d) a central support tube to enclose the shaft and extending from one to the other connecting side of the shaker head;

e) the shaker head having:

i) a support centerplate and two parallel and spaced-apart support plates on either side of the support centerplate, said plates extending from the top back plate to the bottom piece of the shaker head;

ii) the centerplate and lateral support plates and connecting side plates having a plurality of selected positioned holes therein;

f) mounting clip means generally centrally positioned on the central support tube and on the top back plate and bottom piece, the mounting clip means positioned so as to receive and secure thereto additional support plates when the upper separating surface comprises a woven screen or a perforated plate, and not to interfere with a rod-finger upper separating surface; and g) kit means to provide the shaker head with an upper woven screen or perforated plate separating surface or to provide an upper rod-finger separating surface.

2. The apparatus of claim 1 which includes a lower separating surface on the shaker head, spaced-apart from the upper separating surface and extending from the tall end to the short end, the lower separating surface adapted to separate feed material falling through the upper separating surface into a finer material which passes through the lower separating surface and into the interior space and a coarse material which is discharged from the short end of the frame.

3. The apparatus of claim 1 which includes a first and a second laterally extended support tube, each positioned generally equidistant on either side of the central support tube and the bottom edges of the support centerplate and lateral support plates contoured to snugly fit against said support tubes.

4. The apparatus of claim 1 which includes a tow bar means on one side of the frame and moveable wheels on the other side of the frame, the wheel adapted to move between a road-transport position and a non-road-transport, stationary position.

5. The apparatus of claim 1 wherein the mounting clip means comprises a plurality of generally equidistant pairs of central mounting clips extending generally longitudinally on either side from the central support tube and a plurality of secured, right angle, mounting clips on the top back plate and bottom piece and longitudinally aligned with the central mounting clips.

6. The apparatus of claim 1 which includes adjustable flange alignment means at each end of the support centerplate and lateral side plates to provide for alignment of the plates.

7. The apparatus of claim 1 wherein the finger-rod kit means comprises:

a) a plurality of combs, each having a plurality of outwardly extended finger-rods to provide at least two separate, spaced-apart tiers on and secured to the shaker head, for vibratory movement of the upper finger-rod separating surface;

b) a plurality of mounting brackets secured to and generally uniformly positioned on the centerplate, lateral side, and connecting plates, to which brackets the combs are secured; and c) a plurality of finger-rod support plates, each secured respectively to the centerplate support and lateral support plates, and each finger-rod plate having an upper tier straight edge and at least one lower concavely curved top edge; and d) means to secure the combs, mounting brackets and finger-rod support plates to the shaker head.

8. The apparatus of claim 7 wherein the finger-rod support plates have an upper straight edge for the first tier of the upper separating surface and an intermediate and lower upper edges having a concave curve therein, and the lower edge contoured to fit snugly against the central support tube.

9. The apparatus of claim 7 wherein a pair of the finger-rod support plates are bolted to either side of the support centerplate and the lateral side plates.

10. The apparatus of claim 1 wherein the woven-screen or perforated plate kit means comprises:

a) a plurality of woven-screens or perforated plates to form the upper separating surface;

b) a plurality of screen/plate support plates removably secured between the support centerplate and lateral side support plates by the mounting clip means to provide support for the screens or plates as the upper separating surface; and c) a plurality of elongated support frames each having a flat upper surface, with holes therein to secure the woven screen or perforated plates thereto, to include a pair of said support frames secured to either side of the support centerplate to form aligned upper flat surfaces and one of said support frames secured to each connecting side plate; and d) means to secure the screen/plate supports, screen/plates and support frames to the shaker head.

11. The apparatus of claim 9 which includes screen/plate support plates on either side of the lateral side support plates and generally equidistantly positioned from the support centerplate and lateral support plates.

12. The apparatus of claim 9 wherein the screen/plate support plates and the support centerplate and the lateral side support plates all have a straight upper edge in the same lateral plane and include contoured lower edges to fit snugly against the central support tube.

13. A conversion kit for use in converting a material separating apparatus having a shaker head with a central shaft support tube and a centerplate and lateral side plates, the shaker head having a top back plate, a bottom piece and connecting sides, the shaker head mounted for vibratory movement within a frame with a tall and short end, to provide a vibratory woven metal screen or perforated metal plate on the upper separating surface, which conversion kit comprises:

a) a plurality of woven metal screens or perforated plates to form the upper separating surface of the apparatus;

b) a plurality of screen/plate support plates to support the screens or plates and adapted to be secured in a removable manner to mounting clip means on the central support tube and the shaker head;

c) a plurality of elongated support frames, each a flat upper surface with holes therein for the securing of the screens or plates thereto, the support frames adapted to be secured to either side of the support centerplate and to each connecting side of the shaker head; and d) means to secure the screen or plates, the support plates, and support frames to the shaker head.

14. A conversion kit for use in converting a material separating apparatus having a shaker head with a central support tube and a support centerplate and lateral side support plates, the shaker head having a top back plate, a bottom piece, and connecting sides and mounted for vibratory movement within a frame having a tall end and a short end to provide a vibratory rod-finger as the upper separating surface, which conversion kit comprises:

a) a plurality of combs, each comb having a plurality of spaced-apart finger rods secured thereto and extending therefrom for vibratory movement to provide an upper separating surface;

b) a plurality of right angle mounting brackets adapted to be secured in arranged positions on the connecting sides, the support centerplate and the lateral side support plates to support the combs thereon;

c) a plurality of finger rod support plates adapted to be secured in a removable manner to the central support plate and the lateral side support plates, each finger rod support plate having an upper tier straight-top edge and at least one lower concavely curved top edge; and d) means to secure the combs, mounting brackets, and finger rod support plates to the shaker head.

15. A material separating apparatus having a convertible upper separating surface, the apparatus adapted for the separation of a feed material into a coarse material and a finer material, which apparatus comprises:

a) a frame having a tall and short end and adjoining sides, and defining an interior space for the receipt of the finer material, and having inwardly directed funneling surfaces at the tall end and adjoining sides, to direct feed material onto said upper separating surface;

b) a shaker head mounted for vibratory movement within the frame and having a top back plate, a bottom piece, and connecting side plates;

c) a motor including an eccentric rotatable shaft, to impart a vibratory movement to the shaker head;

d) a central support tube to enclose the shaft, and two side support tubes extending on either side of the central support tubes and generally parallel thereto, and extending from one to the other connecting side of the shaker head;

e) a lower separating surface on the shaker head spaced-apart from the upper separating surface and extending from the tall end to the short end, the lower separating surface adapted to separate feed material falling through the upper separating surface into a finer material which passes through the lower separating surface and into the interior space, and a coarse material which is discharged from the short end of the frame;

f) the shaker head having:

i) a support centerplate and two parallel and spaced-apart support plates on either side of the support centerplate, said plates extending from the top back plate to the bottom piece of the shaker head, the lower edge of the support centerplate and the side lateral plates contoured to fit snugly against the said support tube and the upper edges being straight and generally in the same plane;

ii) the centerplate and lateral support plates and connecting side plates having a plurality of selected positioned holes therein; and g) mounting clip means comprising a first means secured to and extending laterally on either side of the support tubes and generally intermediately positioned between the support centerplate and the lateral side plates; and second means on the top back plate and the bottom piece and generally aligned with the first means, the mounting clip means adapted to receive and be secured to screen/plate support plates when the upper surface is a screen/plate separating surface;

h) conversion kit means to provide the shaker head with an upper woven-screen or perforated plate separating surface or to an upper rod-finger separating surface; and i) a tow bar means on one side of the frame and moveable wheels on the other side of the frame, the wheels adapted to move between a road-transport position and a non-road-transport, stationary position.

* * * * *